US007762286B1

(12) United States Patent
Speaks et al.

(10) Patent No.: US 7,762,286 B1
(45) Date of Patent: Jul. 27, 2010

(54) TERRY WEAVE FABRIC

(75) Inventors: Bradley T. Speaks, Blaine, MN (US); Donald A. Thompson, Jr., Burnsville, MN (US)

(73) Assignee: Target Brands, Inc., Minneapolis, MN (US)

( * ) Notice: Subject to any disclaimer, the term of this patent is extended or adjusted under 35 U.S.C. 154(b) by 7 days.

(21) Appl. No.: 12/410,646

(22) Filed: Mar. 25, 2009

(51) Int. Cl.
*D03D 39/22* (2006.01)
*D03D 27/08* (2006.01)
*D03D 27/00* (2006.01)

(52) U.S. Cl. ..... 139/391; 139/21; 139/396; 139/402; 139/404

(58) Field of Classification Search ..... 139/21, 139/37–47, 383 R, 391, 396, 402, 404
See application file for complete search history.

(56) References Cited

U.S. PATENT DOCUMENTS

| | | | | |
|---|---|---|---|---|
| 350,372 | A | 10/1886 | Leake | |
| 376,664 | A | 1/1888 | Leake | |
| 1,398,752 | A | 11/1921 | Taylor | |
| 1,830,892 | A | 11/1931 | Talbirt | |
| 2,860,669 | A * | 11/1958 | Moberg | 139/402 |
| 2,989,992 | A * | 6/1961 | Hoyer et al. | 139/387 R |
| 3,030,691 | A * | 4/1962 | Law | 428/89 |
| 3,065,520 | A * | 11/1962 | Schmidt | 28/160 |
| 3,169,557 | A | 2/1965 | Holland et al. | |
| 3,302,665 | A | 2/1967 | McHargue | |
| 3,779,286 | A * | 12/1973 | Pfarrwaller | 139/25 |
| 5,447,182 | A * | 9/1995 | Gehrig | 139/396 |
| 6,253,797 | B1 * | 7/2001 | Vogel et al. | 139/396 |
| 7,111,648 | B2 * | 9/2006 | Mitchell et al. | 139/391 |
| 2005/0178458 | A1 * | 8/2005 | Mitchell et al. | 139/396 |
| 2008/0230140 | A1 * | 9/2008 | Santens | 139/396 |

FOREIGN PATENT DOCUMENTS

| | | | |
|---|---|---|---|
| JP | 02139450 | A | 5/1990 |
| JP | 6306735 | A | 1/1994 |

* cited by examiner

*Primary Examiner*—Bobby H Muromoto, Jr.
(74) *Attorney, Agent, or Firm*—Leanne Taveggia Farrell; Westman, Champlin & Kelly, P.A.

(57) ABSTRACT

A terry fabric includes a plurality of longitudinally-oriented ground warp yarns, a plurality of pile warp yarns in parallel with the ground warp yarns and a plurality of weft yarns oriented substantially laterally to the ground warp yarns. Each weave sequence of the terry fabric includes first and second placements of weft yarns in a first shed of the ground warp yarns, third and fourth placement of weft yarns in a second shed of the ground warp yarns and a fifth placement of weft yarn in a third shed of the ground warp yarns and the pile warp yarns such that the pile warp yarns form a pile loop over the first, second, third and fourth placements of weft yarns.

20 Claims, 7 Drawing Sheets

TERRY WEAVE FABRIC

BACKGROUND

In weaving, two sets of yarns or threads, called the warp and the weft, are interlaced together on a loom to form a textile. The loom longitudinally holds the warp yarns, while the weft or filling yarns are placed laterally relative to the warp. To position the weft yarns, neighboring warp yarns are moved up or down to create a space called a shed. The weft yarn is carried through the shed such that the sequence of relative movement of the warp yarns between each shed allows for many different weave structures.

A terry fabric is a textile product made with a looped pile on one or both sides of a woven material. Instead of containing just warp yarns and weft yarns, terry fabric includes at least three groups of yarns: the pile warp, the ground warp and the weft.

Towels made predominantly of terry fabric, can be bought and sold in terms of weight per dozen and commonly manufactured as three-pick terry. In other words, warp yarn is shed three times and a piece of weft yarn is positioned in each shed before the pile warp yarn is pushed up or beaten up to form pile loops. With this technique, a greater portion of the weight of the towel is in the pile warp yarns often the most expensive yarn of the fabric.

The discussion above is merely provided for general background information and is not intended to be used as an aid in determining the scope of the claimed subject matter.

SUMMARY

A terry fabric includes a plurality of longitudinally-oriented ground warp yarns, a plurality of pile warp yarns in parallel with the ground warp yarns and a plurality of weft yarns oriented substantially laterally to the ground warp yarns. The process of forming each weave sequence of the terry fabric is accomplished by shedding the ground warp yarns into a first shed, inserting a first and second placement of weft yarns in the first shed, shedding the ground warp yarns into a second shed, inserting a third and fourth placement of weft yarns in the second shed, shedding the ground warp yarns and the pile warp yarns into a third shed and inserting a fifth placement of weft yarn in the third shed. The first, second, third, fourth and fifth placement of weft yarns and the pile warp yarns are beat up to form a weave sequence.

This Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter. The claimed subject matter is not limited to implementations that solve any or all disadvantages noted in the background.

DETAILED DESCRIPTION

Embodiments described herein include a terry fabric for a towel. Each weave sequence of the terry fabric includes a double insertion of weft in the first and second sheds and a single insertion of weft in the third or final shed. After the third shed, the weft and pile warp yarns are beaten up to move the weft together and to push the pile yarn into a set of loops.

Before describing embodiments of a terry fabric in detail, the process specific to the art of terry fabric weaving is described. Terry fabric weaving involves the interlacing of warp-type yarns or pieces and weft-type yarns or pieces at right angles to each other. There are two types of warp yarns: the ground warp and the pile warp. In general, ground warp yarns and pile warp yarns are ordered throughout a terry fabric in a one-to-one relationship or a two-to-two relationship. In a one-to-one relationship, each ground warp yarn is followed by a pile warp yarn, while in a two-to-two relationship, every two ground warp yarns are followed by two pile warp yarns.

Figure 1:
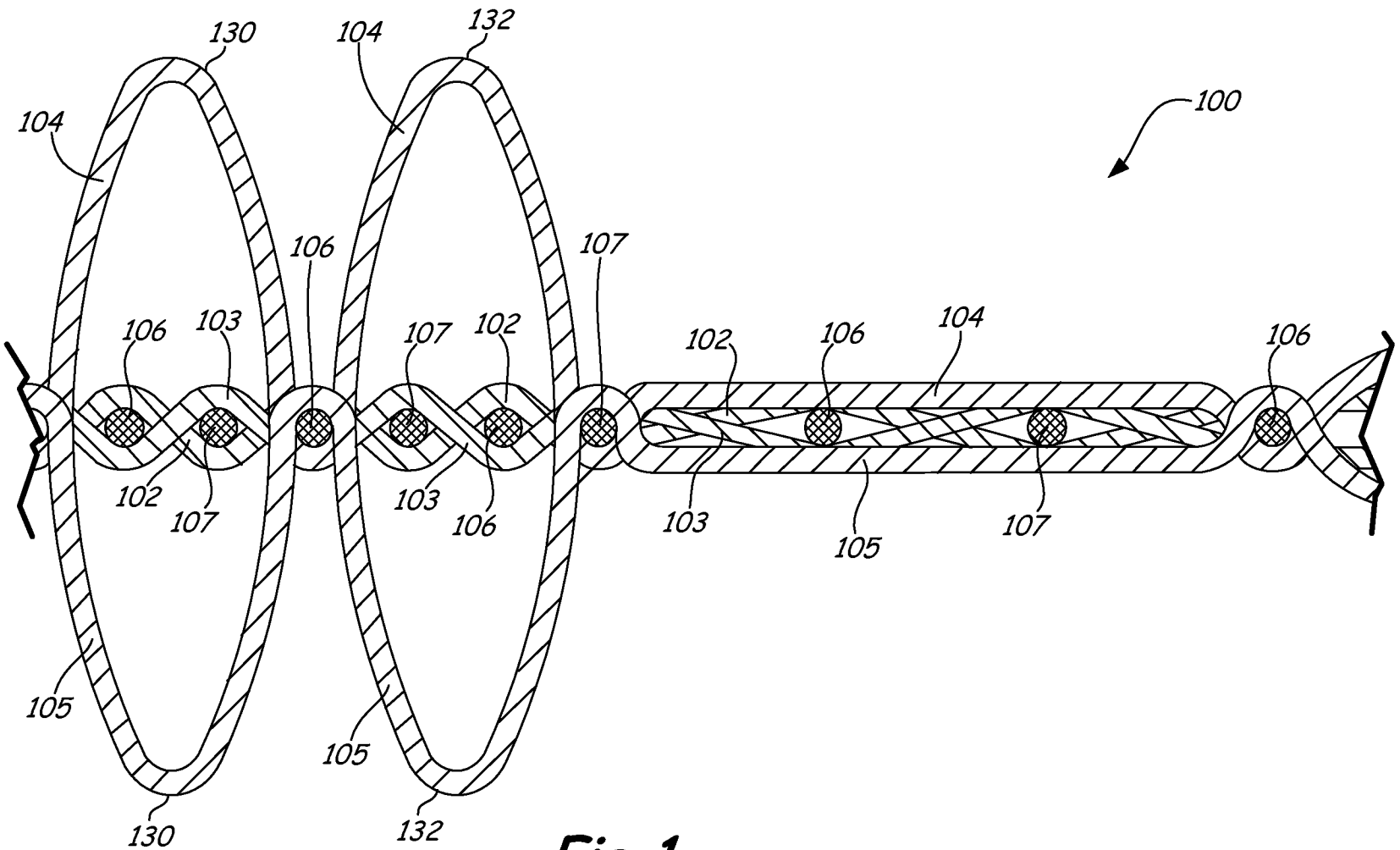
Fig. 1 (RELATED ART)
FIGS. 1-2 illustrate diagrammatic section views of a terry fabric in accordance with related art.
Figure 2:
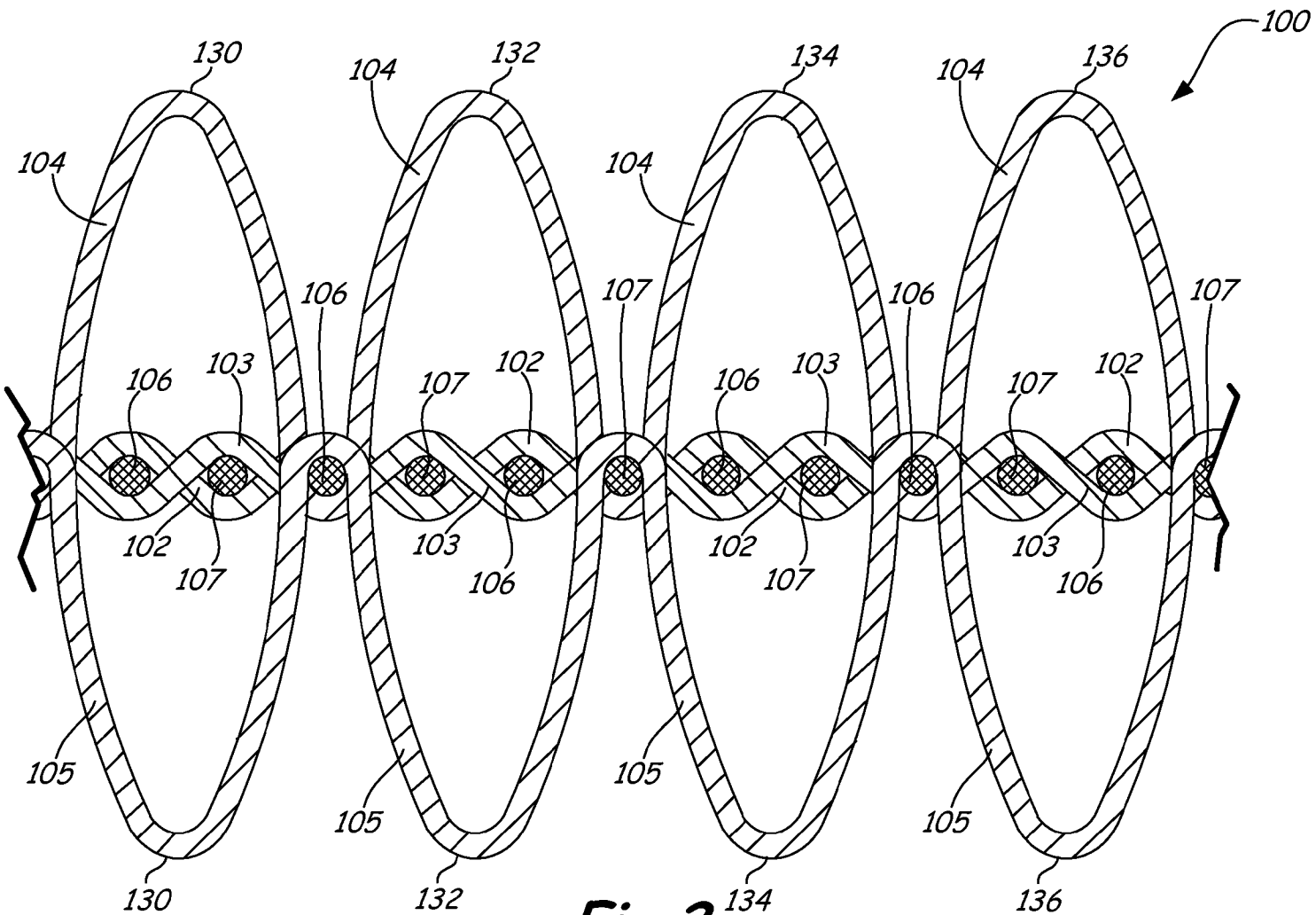
Fig. 2 (RELATED ART)

FIGS. 1 and 2 illustrate diagrammatic section views of a portion of a terry fabric 100 in accordance with related art. FIGS. 1 and 2 illustrate related art terry fabric 100 as having a two-to-two relationship between the ground warp yarns 102 and 103 and the pile warp yarns 104 and 105. In a neutral position, the ground warp yarns 102 and 103 are held tautly on a loom in a parallel and longitudinal order and the pile warp yarns 104 and 105 are held in parallel to the ground warp yarns 102 and 103 on the loom, but loosely.

Every other neighboring ground warp yarn 102 and 103 are moved up or down into a first position to create a space called the shed, in this case the first shed. For example, every other yarn 102 is positioned above every other yarn 103. A piece of the weft yarn is then placed in the first shed. The first weft feeder feeds a piece of the weft yarn 106 through the first shed. This first placement of weft yarn 106 is termed a first pick In the related art, a loom can include an insertion system having at least one weft feeder. An insertion system can propel weft by hand, or mechanically. Example insertion systems include a shuttle, rapier and etc. Each weft feeder includes a yarn package. If the insertion system includes two weft feeders, the insertion system alternates between the two weft feeders and sends yarn through a sequence of sheds. It should be noted, the following discussion pertains to a first weft feeder feeding weft yarn 106 and a second weft feeder feeding weft yarn 107. Although each weft feeder has yarn designated by different numbers, it should be realized that yarns 106 and 107 can be of the same size and fiber type. In addition, it should be realized that the insertion system can include a single weft feeder.

After the first pick, the ground warp yarns 102 and 103 go through another raising or lowering sequence into a second position to form another shed or second shed. For example, every other yarn 103 is positioned above every other yarn 102. In other words, in the second position, the ground warp yarn that was positioned above the other of the ground warp yarns in the proceeding first position is now positioned below the other of the ground warp yarns. The second weft feeder feeds weft yarn 107 through the second shed causing a second placement of a piece of the weft yarn 107 or second pick.

After the second pick, both the ground warp yarns 102 and 103 and the pile warp yarns 104 and 105 go through another raising or lowering sequence into a third position to form yet another shed or third shed. For example, every other yarn 102 is positioned above every other yarn 103. In other words, in the third position, the ground warp yarn that was positioned above the other of the ground warp yarns in the proceeding second position is now positioned below the other of the ground warp yarns and every other neighboring pile warp yarn 104 and 105 are moved up or down. Again, the first weft feeder feeds weft yarn 106 through the third shed causing a third placement of a piece of weft yarn or third pick. The ground warp yarns 102 and 103 and the pile warp yarns 104 and 105 are then returned to a neutral position.

After three picks, each of the three placements of weft yarns 106 and 107 and the pile warp yarns 104 and 105 are beaten up to push the pile warp yarns into a set of loops as well as place each of the three placements of weft yarns a select distance from each other. Therefore, in the third pick, not only is the piece of weft yarn positioned such that it is in contact with the ground warp yarns 102 and 103 as is the case in the first and second picks, but the weft yarn of the third pick is also positioned such that it is in contact with the pile warp yarns 104 and 105. Each beat up completes a weave sequence.

To begin the next weave sequence, the second weft feeder places a piece of weft yarn 107 through a first shed. In the first shed of the next weave sequence, the ground warp yarn that was positioned above the other of the ground warp yarns in the proceeding third position of the proceeding weave sequence is now positioned below the other of the ground warp yarns. For example, every other yarn 103 is positioned above every other yarn 102. Then, the first weft feeder places a piece of weft yarn 106 through a second shed and so on.

In FIG. 1, two sets of three placements of weft yarns 106 and 107 have been beaten up to push two sets of pile warp yarns 104 and 105 into two sets of pile loops 130 and 132, while one set of three positioned series of weft yarns 106 and 107 are about to be beaten up to push a single set of pile warp yarns 104 and 105 into a set of loops. In FIG. 2, four sets of three placements of weft yarns 106 and 107 have been beaten up to push four sets of pile warp yarns 104 and 105 into four sets of loops 130, 132, 134 and 136.

Figure 3:
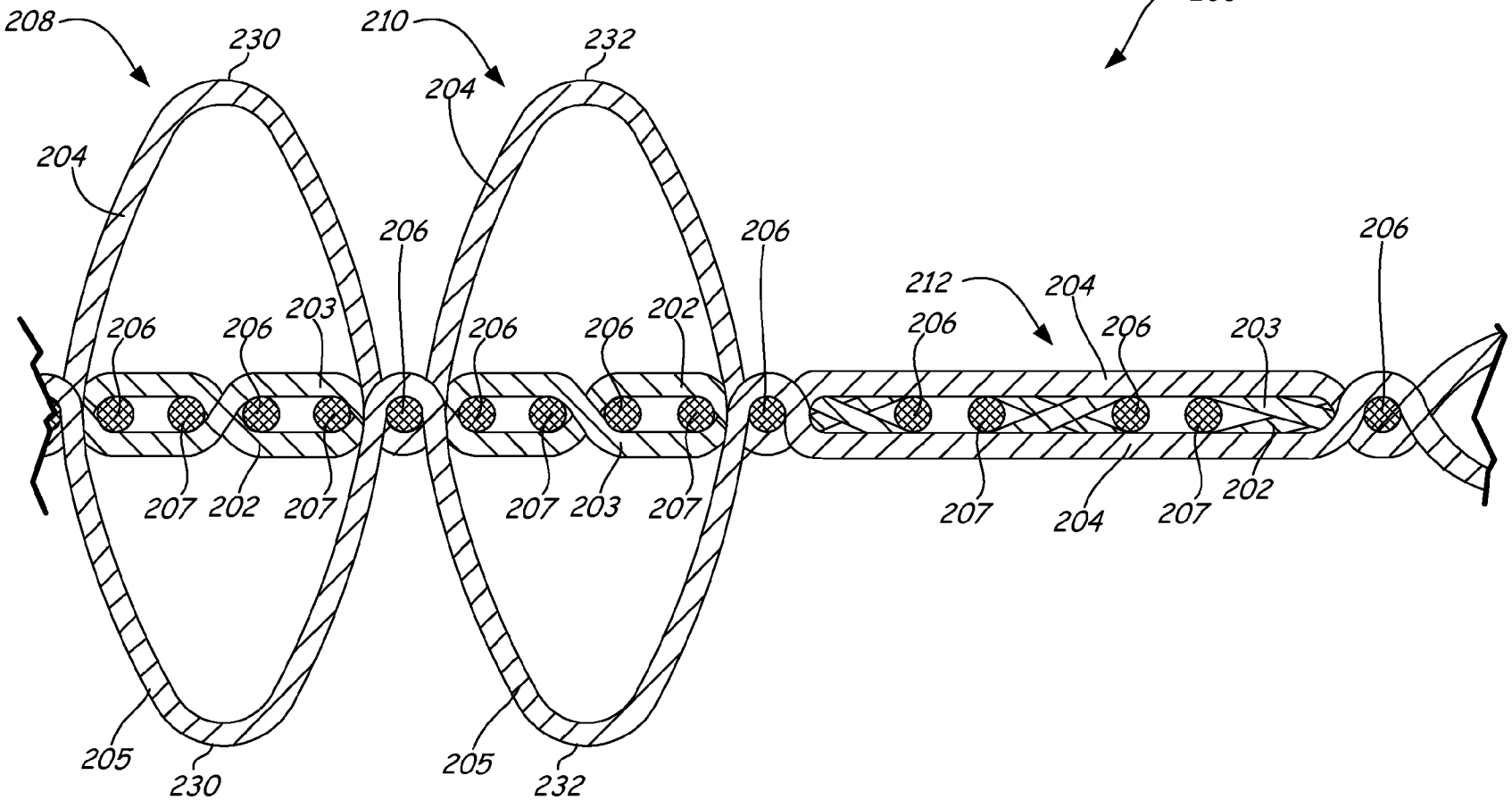
FIG. 3 illustrates a diagrammatic section view of a portion of a terry fabric under one embodiment.
Figure 4:
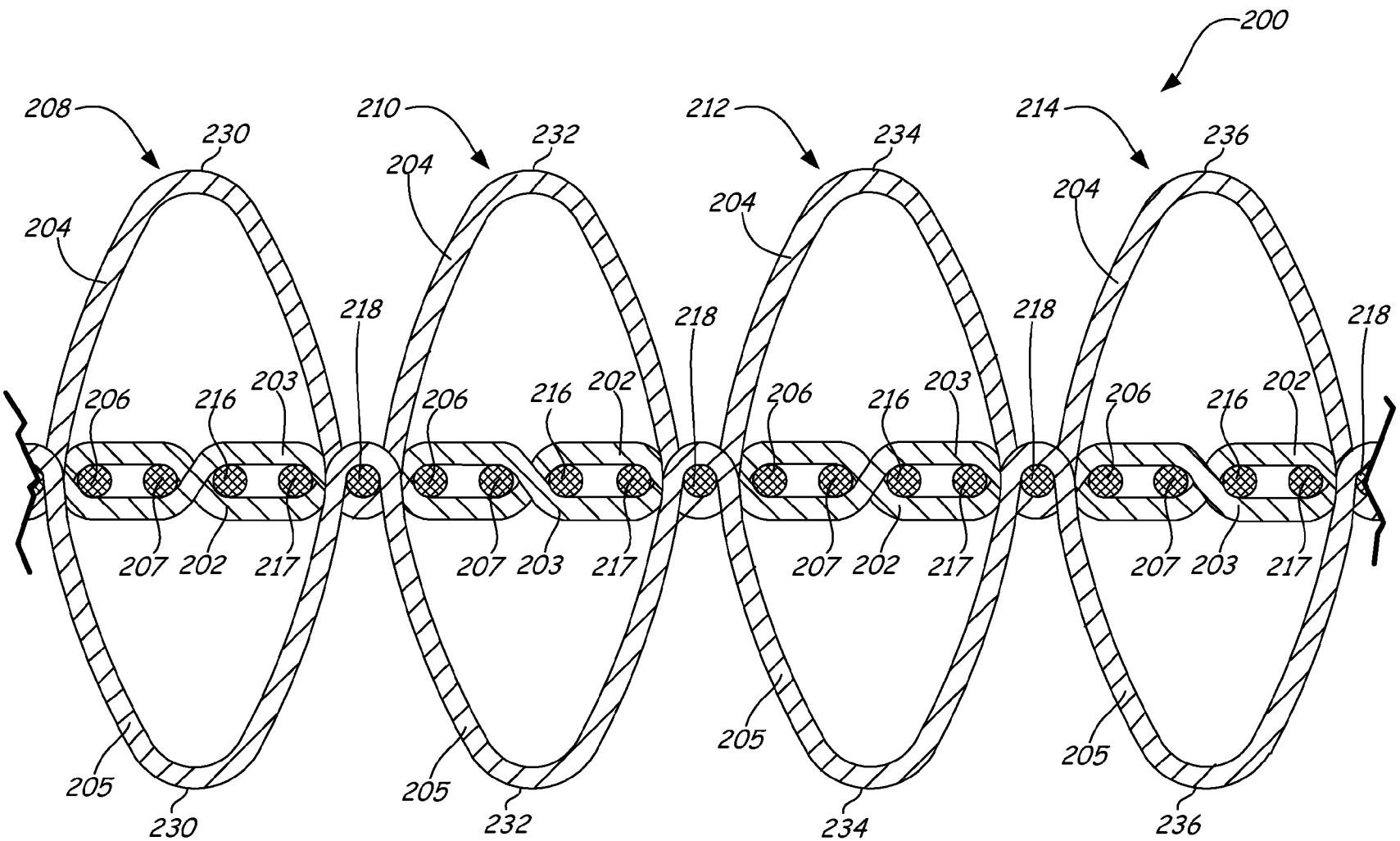
FIG. 4 illustrates another diagrammatic section view of the portion of the terry fabric illustrated in FIG. 3.

FIGS. 3-4 illustrate diagrammatic section views of a portion of a terry fabric 200 under one embodiment. Terry fabric 200 includes a two-to-two relationship between the ground warp yarns 202 and 203 and the pile warp yarns 204 and 205. Although this two-to-two relationship is repeated to form the terry fabric, the views illustrated in FIGS. 3 and 4 only illustrate two of a plurality of ground warp yarns and two of a plurality of pile warp yarns. In a neutral position, the ground warp yarns are held taut on a loom and in a parallel and longitudinal order and the pile warp yarns are held in parallel to the ground warp yarns on the loom, but loosely.

To form the terry fabric, an insertion system for feeding weft yarns can be used to weave between the taut ground warp yarns and pile warp yarns. For example, to form the terry fabric, at least two weft feeders can be used. However, it should be realized that the insertion system could include a single weft feeder. Although portions of the following discussion pertain to the use of at least a first weft feeder feeding a first weft yarn 206 and a second weft feeder feeding a second weft yarn 207, it should be realized that yarns 206 and 207 are of the same type (i.e., same size and kind of fiber) and are placed multiple times within the sequence.

In FIG. 3, three weave sequences 208, 210 and 212 are illustrated. The first two weave sequences 208 and 210 have been beaten up to push pile warp yarns 204 and 205 into two sets of loops 230 and 232, while the third weave sequence 212 is about to be beaten up to push the pile warp yarn into a single set of loops. In FIG. 4, four weave sequences 208, 210, 212 and 214 are illustrated. The four weave sequences 208, 210, 212 and 214 have been beaten up to push pile warp yarns 204 and 205 into four sets of loops 230, 232, 234 and 236.

Figure 5:
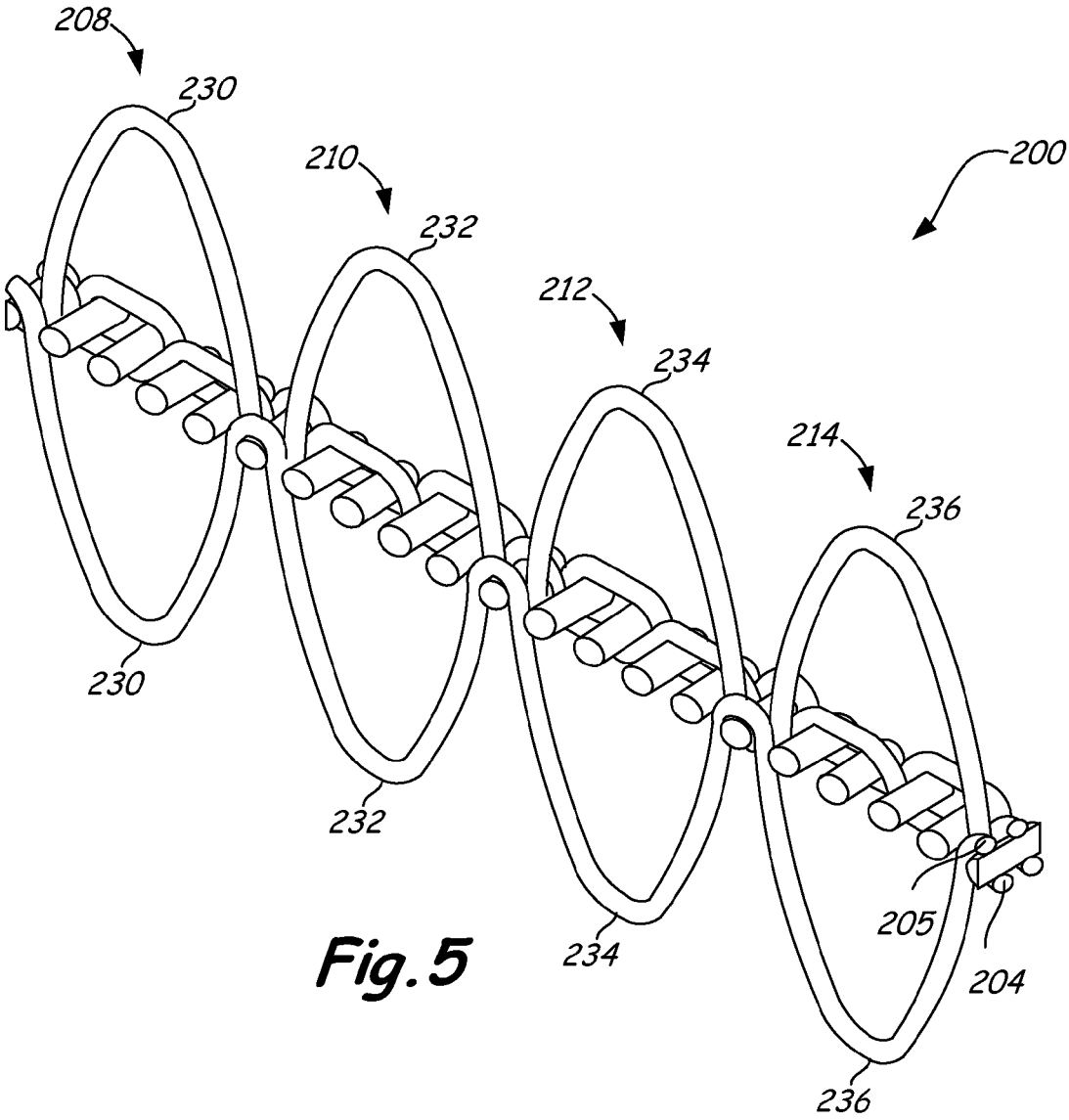
FIG. 5 illustrates a partial perspective view of the portion of terry fabric of FIG. 4.

FIG. 5 provides a partial perspective view of terry fabric 200 as shown in FIG. 4. More specifically, FIG. 5 illustrates the four weave sequences 208, 210, 212 and 214, which have been beaten up to push pole warp yarns 204 and 205 into four sets of loops 230, 232, 234 and 236.

Figure 6:
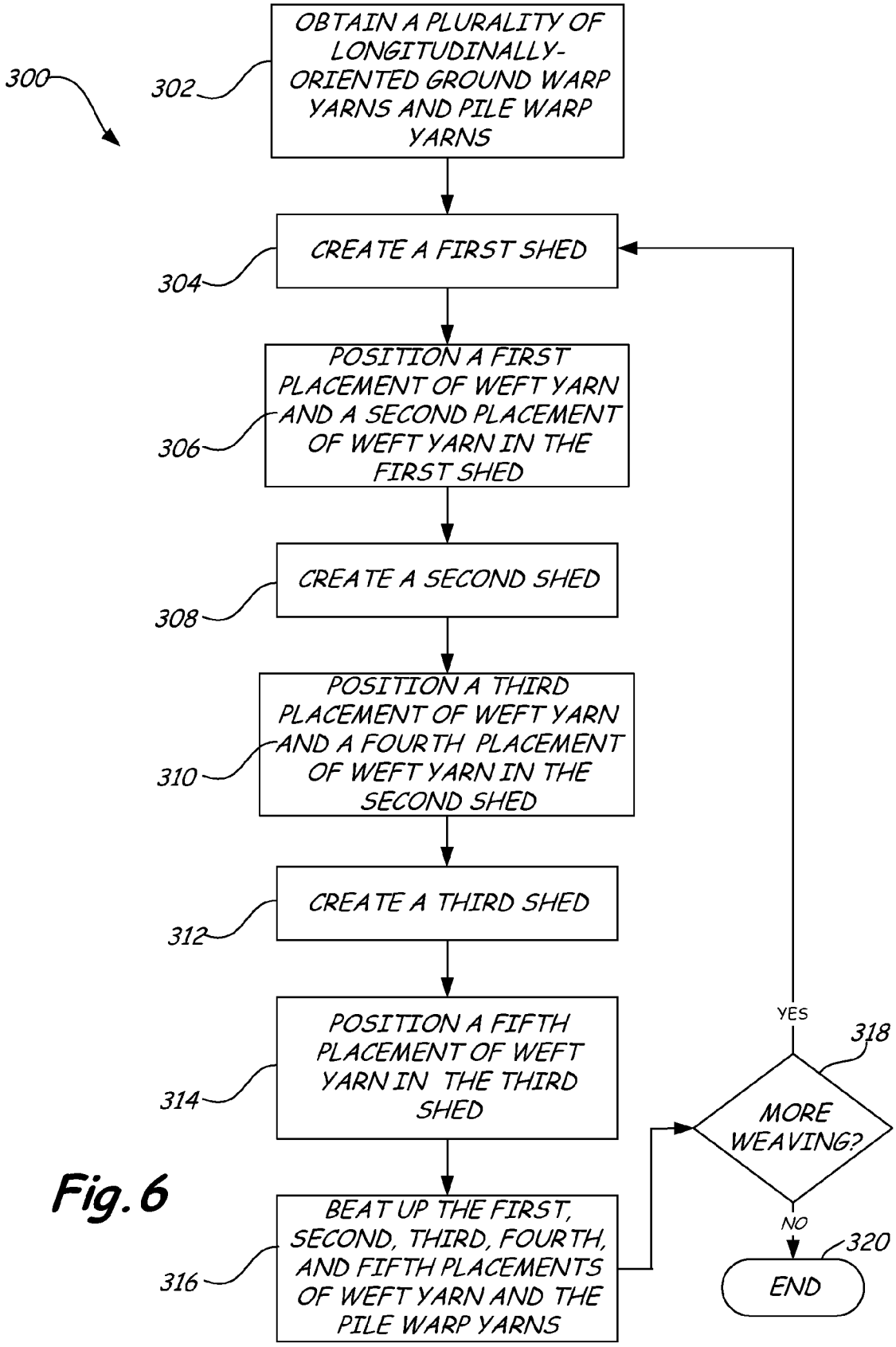
FIG. 6 is a block diagram illustrating a method of forming a terry fabric under one embodiment.

FIG. 6 is a block diagram 300 illustrating a method of forming terry fabric 200. At block 302, a plurality of longitudinally-oriented ground warp yarns 202 and 203 and pile warp yarns 204 and 205 are obtained. At block 304, every other neighboring ground warp yarn 202 and 203 is moved up or down into a first position to create a shed, in this case, the first shed. This movement is defined as the processing of shedding. For example, every other yarn 202 is positioned above every other yarn 203. However, it is also possible for every other yarn 203 to be positioned above every other yarn 202. Instead of placing a single weft yarn through the first shed as is done with respect to terry fabric 100 in FIGS. 1 and 2, a first weft feeder inserts a first placement of weft yarn 206 and a second weft feeder inserts a second placement of weft yarn 207 through the first shed as described in block 306. This first and second placement of weft yarn can be termed a first pick having a double insertion. In other words, in the embodiment illustrated in FIGS. 3-5, there is a double insertion of weft per first pick. For example, in one embodiment, first and second placements consisting of weft yarns 206 and 207 are inserted simultaneously into the first shed by a first weft feeder and a second weft feeder, respectively. It is also possible for the first and second placements of weft yarns 206 and 207 to be inserted separately by a single weft feeder.

After formation of the first pick and at block 308, the ground warp yarns 202 and 203 go through another raising or lowering sequence of ground warp yarns (i.e., shedding) into a second position to create another shed or second shed. For example, every other yarn 203 is positioned above every other yarn 202. In other words, in the second position, the ground warp yarn that was positioned above the other of the neighboring ground warp yarns in the proceeding first position is now positioned below the other of the neighboring ground warp yarns, Therefore, it is also possible for every other yarn 202 to be positioned above every other yarn 203. Again, instead of placing a single weft yarn through the second shed as is done with respect to terry fabric 100 in FIGS. 1 and 2, first weft feeder inserts a third placement of weft yarn consisting of weft yarn 206 and second weft feeder inserts a fourth placement of weft yarn consisting of weft yarn 207 through the second shed as described in block 310. This third and fourth placement of weft yarns can be termed a second pick having a double insertion. In other words, in the embodiment illustrated in FIGS. 3-5, there is a double insertion of weft per second pick. For example, in one embodiment, third and fourth placements of weft yarns consisting of weft yarns 206 and 207 are inserted simultaneously into the second shed by the first and second weft feeders. It is also possible for the third and fourth placements of weft yarns 206 and 207 to be inserted separately by a single weft feeder.

After the second pick and at block 312, both the ground warp yarns 202 and 203 and the pile warp yarns 204 and 205 go through another raising or lowering sequence (i.e., shedding) to create yet another shed or third shed. For example, every other yarn 202 is positioned above every other yarn 203. In other words, in the third position, the ground warp yarn that was positioned above the other of the neighboring ground warp yarns in the proceeding second position is now positioned below the other of the neighboring ground warp yarns. Therefore, it is also possible for every other yarn 203 to be positioned above every other yarn 202. In addition, in the third shed, every other neighboring pile warp yarn 204 and 205 are also moved up or down in a position opposite from the previous third shed in the previous weave sequence in terry fabric 200. One of the first or second weft feeders inserts a fifth placement of weft yarn consisting of a single placement of weft yarn 206 or 207 through the third shed as described in block 314. This fifth placement of weft yarn can be termed a third pick In the third pick, not only is surface area of the fifth placement of weft yarn 206 or 207 in contact with a surface area of the ground warp yarns 202 and 203, but a surface area of the fifth placement of weft yarn 206 or 207 is in contact with a surface area of the pile warp yarns 204 and 205 as well. In addition, because there is only a single placed weft yarn in the third shed compared to the first and second sheds, each of the ground warp yarns 202 and 203 are in contact with a greater surface area of the fifth placed weft yarn 218 than that of the first 206, second 207, third 216 and fourth 217 placed weft yarns.

As illustrated in FIGS. 4 and 5, single weft yarn 206 is placed into each third shed of each weave sequence 208, 210, 212, 214 and so on. However, in other embodiments and not specifically illustrated, weft yarn 207 could be placed into each third shed of each weave sequence 208, 210, 212, 214 and so on or weft yarn 206 could be placed into every other weave sequence 208, 212 while weft yarn 207 is placed into the every other weave sequences 210, 214. In yet another embodiment, weft yarn can be placed into each third shed of each weave sequence 208, 210, 212 and 214 by a third weft feeder. In such a case, the third weft feeder includes weft yarn of the same kind of fiber and same size as the first and second weft feeders. It should be realized that any combination of two weft feeders can be used to place weft yarn in the three sheds of one weaving sequence and any combination of three weft feeders can be used to place weft yarn in the three sheds of one weaving sequence. In addition, a single weft feeder can be used to place weft yarn in the three sheds of one weaving sequence.

At block 316, the series of five weft yarn placements and pile warp yarns 204 and 205 in a weave sequence are beaten up. In each weave sequence 208, 210, 212 and 214, the pile warp yarns 204 and 205 are pushed up into a set of loops 230, 232, 234 and 236. In addition, each of the five placements of weft yarns 206 and 207 are pushed together such that they are each at a select distance from each other. The select distance can be any distance that secures the yarns together tautly to form a quality fabric.

At step 318, it is decided whether weaving is to continue. If weaving is not to continue, the process of weaving ends at step 320. If weaving is to continue, the process returns to step 304 to form the next weave sequence in terry fabric 200. Upon returning to step 304, ground warp yarns 202 and 203 go through a raising or lowering sequence into a first position to create a first shed. Whether or not ever other ground warp yarn 202 is positioned above every other ground warp yarn 203 or every other ground warp yarn 203 is positioned above every other ground warp 202 is based on the proceeding third shed in the proceeding weave sequence. If ground warp yarn 202 was above ground warp yarn 203 in the proceeding third shed, then ground warp yarn 203 is positioned above ground warp yarn 202 in the first shed of the next weaving sequence.

Figure 7:
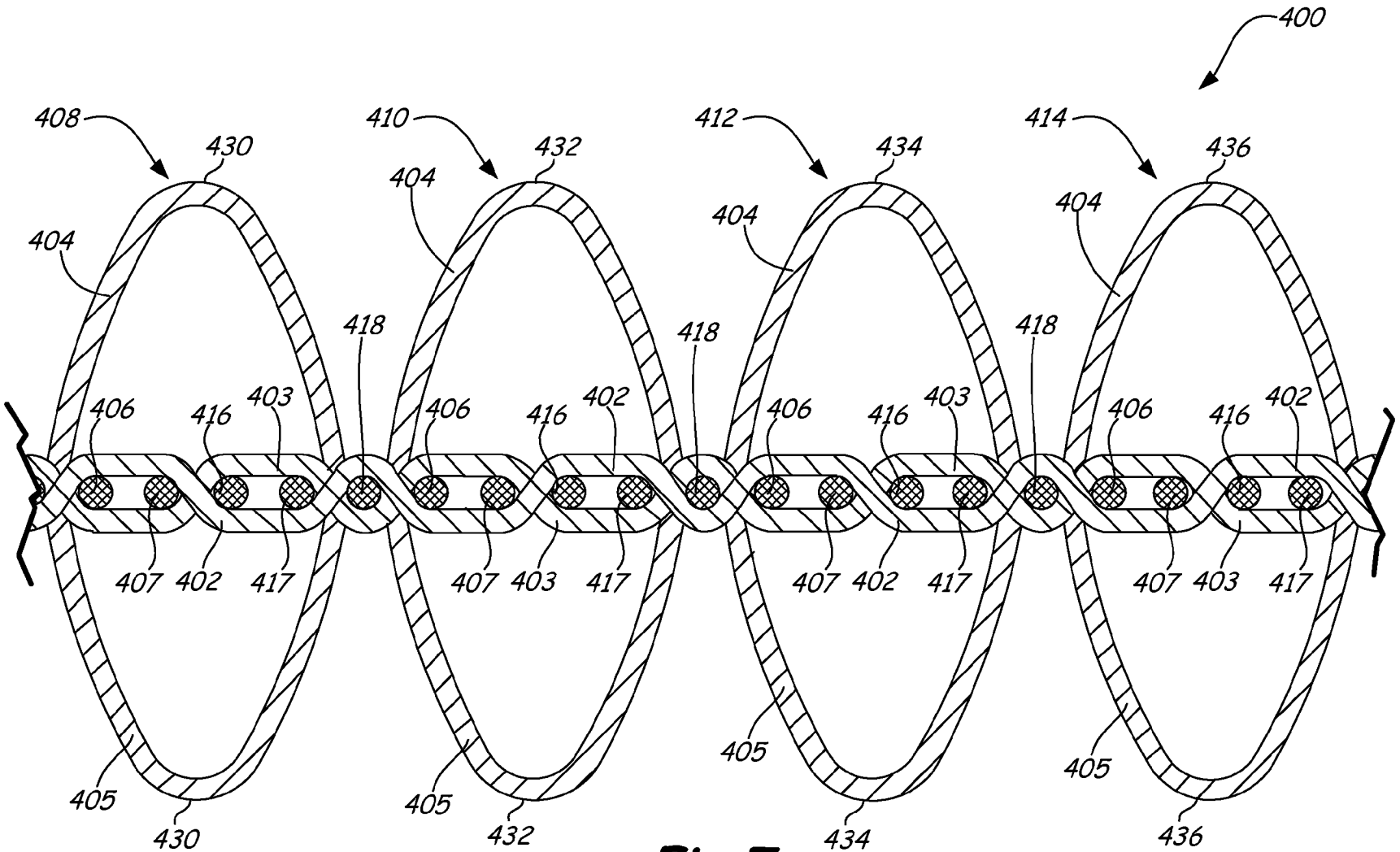
FIG. 7 illustrates a diagrammatic section view of the portion of the terry fabric illustrated in FIG. 4 in accordance with another embodiment.

FIG. 7 illustrates a diagrammatic section view of a portion of a terry fabric 400 in a second embodiment. In FIG. 7, four weave sequences 408, 410, 412 and 414 are illustrated. The four weave sequences 408, 410, 412 and 414 have been beaten up to push pile warp yarns 404 and 405 into four sets of loops 430, 434, 434 and 436.

In FIG. 7, instead of having just two or three weft feeders, terry fabric 400 is formed with at least four weft feeders. With reference back to the method illustrated in FIG. 6, at block 302, a plurality of longitudinally-oriented ground warp yarns 402 and 403 and pile warp yarns 404 and 405 are obtained. At block 304, every other neighboring ground warp yarn 402 and 403 is moved up or down (i.e., shedding) into a first position to create a shed, in this case, the first shed. A first weft feeder inserts a first placement of weft yarn 406 and a second weft feeder inserts a second placement of weft yarn 407 through the first shed as described in block 306 (i.e., a first pair of placed weft yarns). This first and second placement of weft yarn can be termed a first pick having a double insertion. In other words, in the embodiment illustrated in FIG. 7, there is a double insertion of weft per first pick For example, in one embodiment, first and second placements of weft yarns 406 and 407 are inserted simultaneously into the first shed by a first weft feeder and a second weft feeder, respectively.

After formation of the first pick and at block 308, the ground warp yarns 402 and 403 go through another raising or lowering sequence (i.e., shedding) of ground warp yarns into a second position to create another shed or second shed. In the second shed, the ground warp yarns 402 and 403 raise or lower opposite from the position they were in during the first shed. Instead of the first and second weft feeders placing the third and fourth placed weft yarns in the second shed as illustrated in the embodiment of FIGS. 3-5, a third weft feeder inserts a third placement of weft yarn 416 and a fourth weft feeder inserts a fourth placement of weft yarn 417 through the second shed as described in block 310 (i.e., a second pair of placed weft yarns). This third and fourth placement of weft yarns can be termed a second pick having a double insertion. In other words, in the embodiment illustrated in FIG. 7, there is a double insertion of weft per second pick. For example, in one embodiment, third and fourth placements of weft yarns 416 and 417 are inserted simultaneously into the second shed by third and fourth weft feeders.

After the second pick and at block 312, both the ground warp yarns 402 and 403 and the pile warp yarns 404 and 405 go through a raising or lowering sequence (i.e., shedding) to create yet another shed or third shed. In the third shed, the ground warp yarns 402 and 403 raise or lower opposite from the position they were in during the second shed and every other neighboring pile warp yarn 404 and 405 are also moved up or down, which is opposite from the previous third shed in the previous weave sequence in terry fabric 400. Instead of the first or second weft feeders and for that matter the third or fourth weft feeders placing the fifth placed weft yarn in the third shed, a fifth weft feeder inserts a fifth placement or single placement of weft yarn 418 through the third shed as described in block 314. As discussed with regards to the first and second weft feeders discussed in FIGS. 3 and 4, the first, second, third, fourth and fifth weft feeders used to make terry fabric 400 each have the same type of yarn package (i.e., yarn of the same size and kind) that can be used to weave between the taut ground warp yarns and pile warp yarns.

This fifth placement of weft yarn 418 can be termed a third pick In the third pick, not only is surface area of the fifth placement of weft yarn 418 in contact with a surface area of the ground warp yarns 402 and 403, but a surface area of the fifth placement of weft yarn 418 is in contact with a surface area of the pile warp yarns 404 and 405 as well.

As illustrated in FIG. 7, weft yarn 418 is placed into each third shed of each weave sequence 208, 210, 212, 214 and so on. However, in other embodiments and not specifically illustrated in FIG. 7, any weft yarn 406, 407, 416 and 417 could be placed into each third shed of each weave sequence 408, 410, 412, 414 and so on or each weft yarn 406, 407, 416 and 417 could be placed into the third shed of every other weave sequence. It should be realized that any combination of four different weft feeders can be used to place weft yarn in the three sheds and any combination of five weft feeders can be used to place weft yarn in the three sheds.

At block 316, the series of five placed weft yarns 406, 407, 416, 417 and 418 and pile warp yarns 404 and 405 in each weave sequence are beaten up. In each weave sequence 408, 410, 412 and 414, the pile warp yarns 404 and 405 are pushed up into a set of loops 430, 432, 434 and 436. In addition, each of the five placements of weft yarns 406, 407, 416, 417 and 418 are pushed together such that they are each at a select distance from each other.

In the embodiments illustrated in FIGS. 3-5 and 7 as compared to the related art in FIGS. 1-2, a surface area of pile warp yarns 204, 404 and 205, 405 are less in contact with the weft yarns 206, 207, 406, 407, 416, 417 and 418 than the surface area of pile warp yarns 104 and 105 that are in contact with weft yarns 106 and 107. Therefore, there is less of a coefficient of friction between pile warp yarns 204, 404 and 205, 405 and weft yarns 206, 207, 406, 407, 416, 417 and 418 versus pile warp yarns 104 and 105 and weft yarns 106 and 107 of FIGS. 1-2. However, a high coefficient of friction between pile warp yarns 204, 404 and 206, 406 and weft yarns 206, 207, 406, 407, 416, 417 and 418 can be satisfied in other ways. For example, a diameter of weft yarns 206, 207, 406, 407, 416, 417 and 418 can be increased than that which is illustrated, which increases the contact of surface area between pile warp yarns 204, 404 and 205, 405 and weft yarns 206, 207, 406, 407, 416, 417 and 418 causing the terry weave structure to be tighter. In another example, wefts yarns 206, 207, 406, 407, 416, 417 and 418 can be moved closer together when beaten up.

When making a double insertion of weft in a first pick and a second pick, there are many fabric advantages. To begin with, the orientation of looped pile warp yarn is better. With more weft inserted between looped pile warp yarn, the base of each loop is increased, thus decreasing pile height. A decreased pile height is less likely to twist than pile which is higher. In addition, more weight of the terry fabric is put into the less expensive weft yarns instead of the more expensive pile yarns. Lastly, terry fabric 200 and 400 can be manufactured much faster than that of terry fabric 100 since more placements of weft yarns are positioned per weave sequence making for a more efficient production.

Although the subject matter has been described in language specific to structural features and/or methodological acts, it is to be understood that the subject matter defined in the appended claims is not necessarily limited to the specific features or acts described above. Rather, the specific features and acts described above are disclosed as example forms of implementing the claims.

What is claimed is:

1. A terry fabric comprising:

a plurality of longitudinally-oriented ground warp yarns;

a plurality of pile warp yarns in parallel with the ground warp yarns; and a plurality of weft yarns oriented substantially laterally to the ground warp yarns and pile warp yarns, wherein each weave sequence of the terry fabric comprises first and second placements of weft yarn in a first shed of the ground warp yarns, third and fourth placements of weft yarn in a second shed of the ground warp yarns and a fifth placement of weft yarn in a third shed of the ground warp yarns and pile warp yarns such that the pile warp yarns form a pile loop over the first, second, third and fourth placed weft yarns.

2. The terry fabric of claim 1, wherein a surface area of the pile warp yarns is in contact with a surface area of the fifth placed weft yarn.

3. The terry fabric of claim 1, wherein the first and second placed weft yarns are positioned in the first shed simultaneously to form a first pick.

4. The terry fabric of claim 1, wherein the third and fourth placed weft yarns are positioned in the second shed simultaneously to form a second pick.

5. The terry fabric of claim 1, wherein the first, second, third, fourth and fifth placed weft yarns are beaten together such that each weft yarn is spaced apart from another weft yarn by a selected distance.

6. The terry fabric of claim 1, wherein each of the ground warp yarns is in contact with a surface area of each of the first, second, third, fourth and fifth placed weft yarns.

7. The terry fabric of claim 6, wherein each of the ground warp yarns is in contact with a greater surface area of the fifth placed weft yarn than that of the first, second, third and fourth placed weft yarns.

8. A method of forming a terry fabric comprising:

obtaining a plurality of longitudinally-oriented ground warp yarns and pile warp yarns;

shedding the ground warp yarns into a first shed;

laterally inserting a first pair of placed weft yarns in the first shed and a second shed;

shedding the ground warp yarns into a second shed;

laterally inserting a second pair of placed weft yarns in the second shed;

shedding the ground warp yarns and the pile warp yarns into a third shed;

laterally inserting a single placed weft yarn in the third shed; and beating up the first pair placed weft yarns, the second pair of placed weft yarns, the single placed weft yarn and the pile warp yarns.

9. The method of claim 8, wherein the ground warp yarns are held taut in a loom and the pile warp yarns are held loosely in the loom.

10. The method of claim 8, wherein shedding the ground warp yarns into the first shed comprises moving the ground warp yarns into a first position, wherein in the first position a first set of every other neighboring ground warp yarn is positioned above a second set of the every other neighboring ground warp yarn.

11. The method of claim 10, wherein laterally inserting the first pair of placed weft yarns in the first shed forms a first pick, wherein the first pick includes the simultaneous insertion of the first pair of placed weft yarns in the first shed.

12. The method of claim 10, wherein shedding the ground warp yarns into the second shed comprises moving the ground warp yarn into a second position, wherein in the second position the second set of the every other neighboring ground warp yarn is positioned above the first set of every other neighboring ground warp yarn.

13. The method of claim 12, wherein laterally inserting the second pair of placed weft yarns in the second shed forms a second pick, wherein the second pick includes the simultaneous insertion of the second pair of placed weft yarns in the second shed.

14. The method of claim 12, wherein shedding the ground warp yarns and the pile warp yarns into the third shed comprises moving the ground warp yarn into a third position, wherein in the third position the first set of every other neighboring ground warp yarn is positioned above the second set of the every other neighboring ground warp yarn such that neighboring ground yarns are in the same position relative to each other as in the first shed.

15. The method of claim 14, wherein laterally inserting the single placed weft yarn in the third shed forms a third pick.

16. The method of claim 15, wherein beating up the first pair of placed weft yarns, second pair of placed weft yarns, the single placed weft yarn and the pile warp yarns comprises beating up the first pair of placed weft yarns, second pair of placed weft yarns, the single placed weft yarn and the pile warp yarns such that each weft yarn is spaced apart from each other by a select distance.

17. A method of weaving comprising:

obtaining a plurality of taut ground warp pieces in parallel with a plurality of loose pile warp pieces;

forming a first shed with the ground warp pieces;

positioning a first and a second placement of weft pieces in the first shed;

forming a second shed with the ground warp pieces;

positioning a third and fourth placement of weft pieces in the second shed;

forming a third shed with the ground warp pieces and the pile warp pieces;

positioning a fifth placement of weft piece in the third shed; and beating up the first, second, third, fourth and fifth placements of weft pieces and the pile warp pieces to form a first weave sequence.

18. The method of claim 17, wherein positioning the first, second, third, fourth and fifth placement of weft pieces in the first shed, second and third sheds comprise positioning the first, second, third, fourth and fifth placement weft pieces with at least two weft feeders.

19. The method of claim 17, wherein positioning the first, second, third, fourth and fifth placement of weft pieces in the first, second and third sheds comprises positioning the first, second, third, fourth and fifth placement weft pieces with at least four weft feeders.

20. The method of claim 17, wherein positioning the first, second, third, fourth and fifth placement of weft pieces in the first, second and third sheds comprises positioning the first, second, third, fourth and fifth placement weft pieces with at five weft feeders.

* * * * *